US009488416B2

(12) United States Patent
Fujita et al.

(10) Patent No.: US 9,488,416 B2
(45) Date of Patent: Nov. 8, 2016

(54) MULTISTAGE PRESSURE CONDENSER AND STEAM TURBINE PLANT HAVING THE SAME

(71) Applicant: Mitsubishi Heavy Industries, Ltd., Tokyo (JP)

(72) Inventors: Issaku Fujita, Tokyo (JP); Jiro Kasahara, Tokyo (JP); Seiho Utsumi, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 322 days.

(21) Appl. No.: 13/684,916

(22) Filed: Nov. 26, 2012

(65) Prior Publication Data

US 2013/0167536 A1 Jul. 4, 2013

(30) Foreign Application Priority Data

Nov. 28, 2011 (JP) ..... 2011-258932

(51) Int. Cl.
*F28B 1/00* (2006.01)
*F28B 1/02* (2006.01)
(Continued)

(52) U.S. Cl.
CPC ..... *F28B 1/00* (2013.01); *F01K 9/003* (2013.01); *F28B 1/02* (2013.01); *F28B 7/00* (2013.01); *F28B 9/08* (2013.01)

(58) Field of Classification Search
CPC ..... F28B 1/00; F28B 7/00; F28B 9/08; F28B 1/02; F01K 9/003
USPC ..... 60/685–697; 261/146–149; 96/155–220
See application file for complete search history.

(56) References Cited

U.S. PATENT DOCUMENTS 3,157,229 A 11/1964 Wennerberg
3,659,623 A 5/1972 Facius
(Continued)

FOREIGN PATENT DOCUMENTS

CN 1143329 2/1997
CN 1419038 5/2003
(Continued)

OTHER PUBLICATIONS

Chinese Office Action issued Apr. 3, 2015 in corresponding Chinese Patent Application No. 201280041658.6 with partial English translation.
(Continued)

*Primary Examiner* — Thomas Bennett McKenzie
(74) *Attorney, Agent, or Firm* — Wenderoth, Lind & Ponack, L.L.P.

(57) ABSTRACT

A multistage pressure condenser includes, a high pressure chamber and a low pressure chamber, a pressure partition wall which partitions an inner portion of the low pressure chamber to an upper portion and a lower portion, a cooling pipe group which condenses low pressure side steam to low pressure side condensate, a reheat chamber positioned in the lower portion of the low pressure chamber and in which the low pressure side condensate which flows down through the porous plate is stored, high pressure side steam introduction portion for introducing high pressure side steam in the high pressure chamber to the reheat chamber, liquid-film forming portion which guides the low pressure side condensate which flows down through the porous plate to the reheat chamber while dispersing the low pressure side condensate on a surface, and air feeder for promoting the flow of the high pressure side steam.

11 Claims, 8 Drawing Sheets

(51) Int. Cl.

| | |
|---|---|
| ***F28B 7/00*** | (2006.01) |
| ***F01K 9/00*** | (2006.01) |
| ***F28B 9/08*** | (2006.01) |

(56) References Cited

U.S. PATENT DOCUMENTS

| | | | | |
|---|---|---|---|---|
| 3,817,323 | A | 6/1974 | Ebara et al. | |
| 3,870,485 | A | 3/1975 | Shiraishi et al. | |
| 4,198,215 | A | 4/1980 | Regehr | |
| 4,360,060 | A | 11/1982 | Collgon | |
| 4,366,675 | A | 1/1983 | Nishioka | |
| 4,598,767 | A | 7/1986 | Saleh | |
| 4,762,650 | A | 8/1988 | Bosman | |
| 4,890,670 | A | 1/1990 | Schiessl | |
| 4,976,100 | A * | 12/1990 | Lee | F01K 23/108 60/39.182 |
| 5,182,925 | A | 2/1993 | Alvarez et al. | |
| 5,671,804 | A * | 9/1997 | Kordelin | 165/46 |
| 5,925,291 | A | 7/1999 | Bharathan et al. | |
| 6,814,345 | B2 | 11/2004 | Inoue | |
| 6,854,278 | B2 | 2/2005 | Maisotsenko et al. | |
| 2003/0090010 | A1 | 5/2003 | Inoue | |
| 2005/0034455 | A1 | 2/2005 | Inoue | |
| 2006/0278089 | A1 | 12/2006 | Theilow | |
| 2010/0319879 | A1 * | 12/2010 | Sugitani | F01K 9/00 165/104.21 |
| 2012/0216541 | A1 * | 8/2012 | Fujita et al. | 60/670 |

FOREIGN PATENT DOCUMENTS

| | | | | |
|---|---|---|---|---|
| CN | 101627276 | | 1/2010 | |
| CN | 101929807 | | 12/2010 | |
| EP | 2 218 999 | | 8/2010 | |
| JP | 47-26505 | | 10/1972 | |
| JP | 49-32002 | | 3/1974 | |
| JP | 57-196085 | | 12/1982 | |
| JP | 61-11590 | | 1/1986 | |
| JP | 7-58043 | | 6/1995 | |
| JP | 9-511322 | | 11/1997 | |
| JP | 11-173768 | | 7/1999 | |
| JP | 2003-148876 | | 5/2003 | |
| JP | 3706571 | | 10/2005 | |
| JP | 3706571 | B2 * | 10/2005 | |
| JP | 2007-24411 | | 2/2007 | |
| JP | 2009-052867 | | 3/2009 | |
| JP | WO 2009050892 | A1 * | 4/2009 | F01K 9/00 |
| JP | 2009-97788 | | 5/2009 | |
| JP | 2012-180956 | | 9/2012 | |
| WO | WO 2009050892 | A1 * | 4/2009 | |
| WO | 2009/075300 | | 6/2009 | |

OTHER PUBLICATIONS

International Search Report issued Dec. 6, 2011 in International (PCT) Application No. PCT/JP2011/071277 with English Translation.

Written Opinion of the International Searching Authority issued Dec. 6, 2011 in International (PCT) Application No. PCT/JP2011/071277 with English Translation.

Korean Office Action issued Jul. 28, 2014 in Korean Patent Application No. 10-2013-7001159 with English Translation.

U.S. Office Action issued May 9, 2013 in U.S. Appl. No. 13/239,621.

U.S. Office Action issued Oct. 11, 2013 in U.S. Appl. No. 13/239,621.

U.S. Advisory Action issued Feb. 5, 2014 in U.S. Appl. No. 13/239,621.

U.S. Office Action issued Mar. 3, 2014 in U.S. Appl. No. 13/239,621.

U.S. Office Action issued Jul. 17, 2014 in U.S. Appl. No. 13/239,621.

U.S. Advisory Action issued Oct. 28, 2014 in U.S. Appl. No. 13/239,621.

U.S. Office Action issued Feb. 3, 2015 in U.S. Appl. No. 13/239,621.

Extended European Search Report issued Feb. 19, 2015 in European Patent Application No. 11859853.1.

Chinese Office Action issued May 22, 2014 in corresponding Chinese Patent Application No. 201180037157.6 with English translation.

Korean Office Action issued Jul. 21, 2015 in corresponding Korean Application No. 10-2014-7004598 with English translation.

Japanese Office Action issued Jul. 28, 2015 in corresponding Japanese Application No. 2013-547153 with English translation.

International Search Report mailed Mar. 5, 2013 issued in International (PCT) Application No. PCT/JP2012/080568 with English translation.

Machine translation of JP 3706571 having a publication date of Oct. 12, 2005.

Written Opinion of the International Searching Authority mailed Mar. 5, 2013 issued in International (PCT) Application No. PCT/JP2012/080568 with English translation.

* cited by examiner

MULTISTAGE PRESSURE CONDENSER AND STEAM TURBINE PLANT HAVING THE SAME

TECHNICAL FIELD

The present invention relates to a multistage pressure condenser and a steam turbine plant having the same.

The present application claims priority on Japanese Patent Application No. 2011-258932, filed Nov. 28, 2011, the content of which is incorporated herein by reference.

BACKGROUND ART

In general, in a steam turbine plant or the like, steam which drives a steam turbine is exhausted from the turbine and is introduced to a condenser. The steam which is introduced to the condenser exchanges heat with cooling water which is introduced to the condenser, is condensed, and becomes a condensate. The condensate which is condensed in the condenser is heated through a feed water heater and is supplied to a boiler. The condensate which is supplied to the boiler becomes steam and is used as a driving source of the steam turbine.

For example, FIG. 7 shows a schematic configuration view of a multistage pressure condenser 101 having two stages which includes a high pressure condenser and a low pressure condenser.

A low pressure side condenser 103 of the multistage pressure condenser 101 includes a pressure partition wall 111 which partitions a low pressure side body 6 in the longitudinal direction into an upper portion and a lower portion and has a porous plate 113, a low pressure side cooling pipe group 7 which is provided in the upper portion side of the low pressure side body 6 and to which cooling water is introduced, and a reheat chamber 112 which is positioned in the lower portion of the low pressure side body 6.

The exhaust (steam) from a steam turbine (not shown) which is introduced to the low pressure side body 6 exchanges heat with the cooling water which is introduced to the low pressure side cooling pipe group 7, and thus, is condensed, becomes a low pressure side condensate, is collected in the upper portion of the pressure partition wall 111, and becomes a condensate collection 10. Since a plurality of holes 14 are provided on the porous plate 113 of the pressure partition wall 111, the low pressure side condensate flows from the condensate collection 10 down to the reheat chamber 112.

A steam duct 16, which introduces the exhaust (steam) of the steam turbine of the upper portion of a high pressure side condenser 102 to the reheat chamber 112 of the low pressure side condenser 103, is connected to the reheat chamber 112. Thereby, the low pressure side condensate, which flows down to the reheat chamber 112, comes into gas-liquid contact with the high pressure side steam which is introduced from the steam duct 16, and is reheated. The longer the duration of the gas-liquid contact between the reheated low pressure side condensate and the exhaust of the high pressure side steam, the more efficient reheating becomes.

In order to increase the duration of the gas-liquid contact, as shown in FIG. 7, Patent Document 1 discloses that a tray 21 is provided which stores the low pressure side condensate flowing down from the porous plate 113 in the reheat chamber 112 and makes the condensate overflow.

PRIOR ART DOCUMENT

Patent Document

Patent Document 1: Japanese Patent No. 3706571

DISCLOSURE OF THE INVENTION

Problem that the Invention is to Solve

However, recently, it is preferable to further increase the duration of gas-liquid contact than the duration of the invention disclosed in Patent Document 1 and improve the reheating efficiency.

In the technology disclosed in Patent Document 1, when pressure difference in the body between the high pressure side condenser 102 and the low pressure side condenser 103 is large (for example, 50 mmHg), the water level of the condensate collection 10 of the low pressure side condenser 103 is high, and there is a concern that the low pressure side cooling pipe group 7 which is positioned above the pressure partition wall 111 may come into contact with the condensate collection 10.

Thereby, as shown in FIG. 8, measures are taken which lower a portion 111*a* of the pressure partition wall 111 of the low pressure side condenser 103 to the reheat chamber 112 side by approximately 50 cm, for example, increase the volume of the condensate collection 10, and prevent the low pressure side cooling pipe group (not shown) from coming into contact with the condensate collection 10. However, when the portion 111*a* of the pressure partition wall 111 is lowered to the reheat chamber 112 side in this way, the distance from the portion 111*a* of the porous pressure partition wall 111 to the tray 21 is decreased, and the duration of the gas-liquid contact between the low pressure side condensate which flows down and the high pressure side steam is decreased, and thus, there is a problem in that the reheating efficiency is decreased.

On the other hand, when the low pressure side cooling pipe group is provided in the upper portion so as to be further separated from the condensate collection without lowering a portion of the pressure partition wall to the reheat chamber side, there is a problem in that the size of the overall condenser is increased.

An object of the present invention is to provide a multistage pressure condenser capable of further improving reheating efficiency without increasing the size and a steam turbine plant having the same.

Means for Solving the Problem (1) A multistage pressure condenser according to the present invention includes: a plurality of pressure chambers in which pressures are different from one another; a high pressure chamber, which is maintained to a first steam pressure, of the pressure chambers; a low pressure chamber, which is maintained to a second steam pressure which is lower than the first steam pressure, of the pressure chambers; a pressure partition wall configured to partition an inner portion of the low pressure chamber to an upper portion and a lower portion and which includes a porous plate in which a plurality of holes are formed; a cooling pipe group which is provided on the upper portion of the low pressure chamber partitioned by the pressure partition wall and condenses the low pressure side steam to low pressure side condensate by exchanging heat with the low pressure side steam, which is introduced to the low pressure chamber, through introduced cooling water; a reheat chamber which is positioned in the lower portion of the low pressure chamber partitioned by the pressure partition wall and in which the lower pressure side condensate which flows down through the porous plate is stored; high pressure side steam introduction portion for introducing high pressure side steam, which is introduced to a high pressure chamber in the high pressure chamber to the reheat chamber; liquid-film forming portion which is provided in a flow channel of the high pressure side steam introduced to the reheat chamber and guides the low pressure side condensate which flows down through the porous plate to the reheat chamber while dispersing the low pressure side condensate on a surface; and air feeder for promoting the flow of the high pressure side steam which is introduced by the high pressure side steam introduction portion.

According to the configuration, the low pressure side condenser in which a liquid-film is formed due to the liquid-film forming portion and the high pressure side steam in which the flow is promoted due to the air feeder come into gas-liquid contact with each other, and thus, forced convection condensation is promoted, and the low pressure side condensate can be further heated.

(2) It is preferable that the air feeder be a vent pipe which is provided in the further downstream side than the liquid-film forming portion in a flow channel direction of the high pressure side steam and circulates the high pressure side steam to the upper portion of the low pressure chamber.

According to the configuration, the flow of the high pressure side steam in the downstream side of the liquid-film forming portion is promoted, and a decrease of the flow rate is prevented. Thereby, forced convection condensation is promoted, and the low pressure side condensate can be further heated.

(3) It is preferable that an adjuster for adjusting a flow rate of the high pressure side steam which flows in the vent pipe be provided in the vent pipe.

According to the configuration, a degree of the forced convection caused by the vent pipe can be adjusted, and thus, the flow rate of the high pressure side steam can be adjusted.

(4) A blower may be used as the air feeder.

According to the configuration, since the flow rate of the high pressure side steam which flows into the liquid-film forming portion is increased due to the blower, the forced convention condensation is promoted, and thus, the low pressure side condensate can be further heated.

(5) It is preferable that the liquid-film forming portion include a plurality of plate-shaped members which are disposed along a flow-down direction of the low pressure side condensate and the flow channel direction of the high pressure side steam, and are disposed to be parallel to each other with intervals in an orthogonal direction perpendicular to the flow-down direction and the flow channel direction, and each plate-shaped member have a shape in which a cross-sectional shape thereof is uneven in the orthogonal direction when viewed from the flow channel direction.

According to the configuration, the low pressure side condensate, which flows down from the pressure partition wall, alternately flows on the inclined surfaces of two adjacent plate-shaped members, and becomes a film. Moreover, the duration, in which the low pressure side condensate moves (flows down) on the surfaces of the plate-shaped members, is increased. Thereby, the duration, in which the low pressure side condensate which flows down on the surfaces of the plate-shaped members and the high pressure side steam come into gas-liquid contact with each other, is increased, and thus, the low pressure side condensate can be further heated.

In addition, since each plate-shaped member is disposed along the flow-down direction of the low pressure side condensate and the flow channel direction of the high pressure side steam, the high pressure side steam is perpendicular to the flow-down direction of the low pressure side condensate, and the high pressure side steam flows to intervals between the plate-shaped members. Thereby, the low pressure side condensate which flows down in a film and the high pressure side steam come into more efficient contact with each other, and thus, the low pressure side condensate can be further heated.

(6) A steam turbine plant according to the present invention includes the multistage pressure condenser.

According to the configuration, since the multistage pressure condenser which can improve reheating efficiency without changing the overall size is provided, efficiency of the steam turbine plant can be improved without changing the overall disposition or the size of the plant.

Effects of the Invention

According to the present invention, the low pressure side condensate in which a liquid-film is formed due to the liquid-film forming portion and the high pressure side steam in which the flow is promoted due to the air feeder come into gas-liquid contact with each other, and thus, forced convention condensation is promoted, and the low pressure side condensate can be further heated.

BEST MODE FOR CARRYING OUT THE INVENTION

First Embodiment

Figure 1:
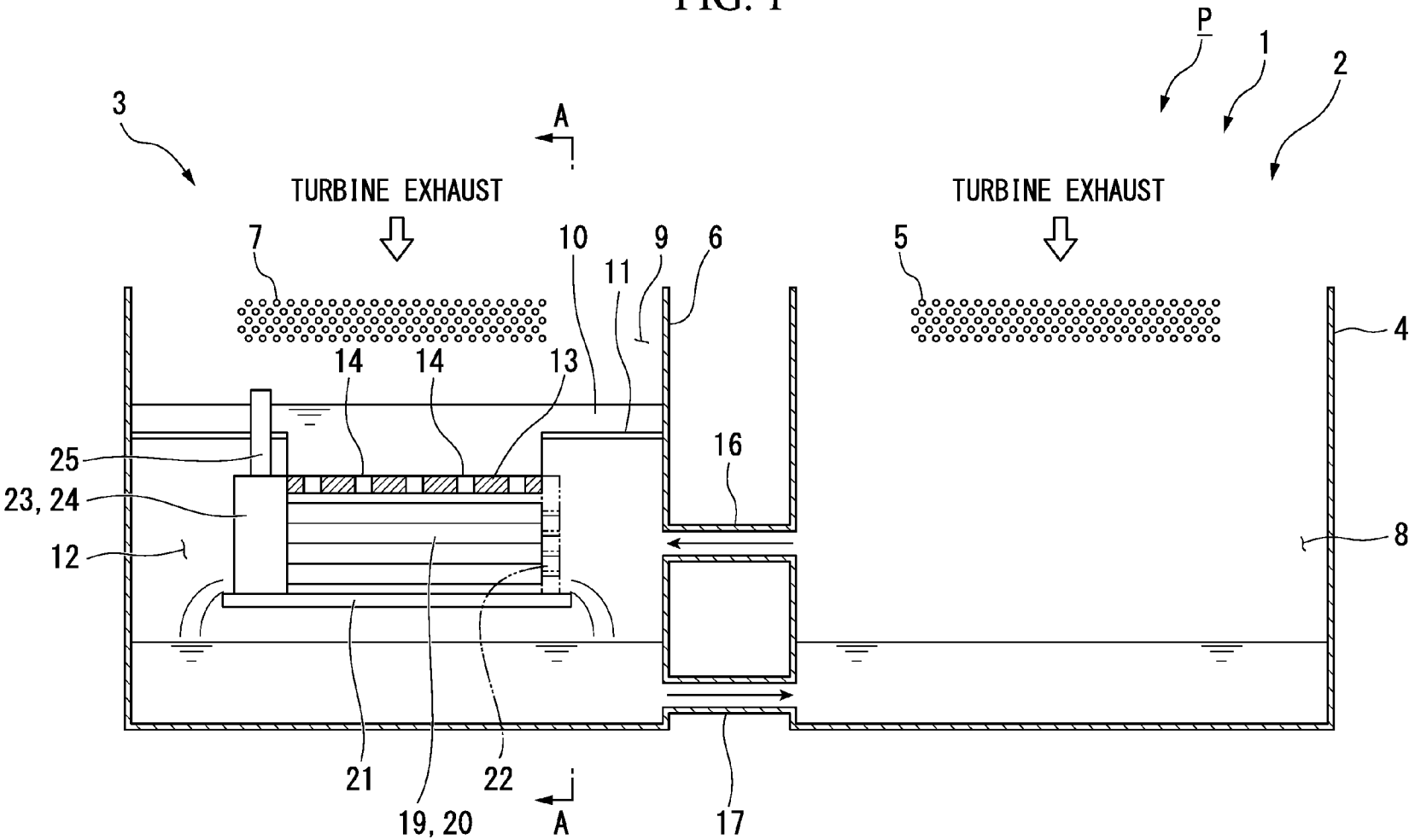
FIG. 1 is a schematic configuration view of a multistage pressure condenser according to a first embodiment of the present invention.

Hereinafter, an embodiment of the present invention will be described in detail referring to drawings. FIG. 1 is a schematic configuration view of a multistage pressure condenser according to the present embodiment. As shown in FIG. 1, a steam turbine plant P includes a steam turbine (not shown), a multistage pressure condenser 1, and a boiler (not shown).

In the steam turbine plant P, steam which finishes expansion work in the steam turbine which includes a high pressure side steam turbine and a low pressure side steam turbine is introduced to the multistage pressure condenser 1 from the steam turbine. The steam is cooled by the multistage pressure condenser 1, and thus, the steam is condensed and becomes condensate. The condensed condensate is supplied to the boiler after it is heated by a feed water heater (not shown). The condensate which is supplied to the boiler becomes steam and is used as a driving source of the steam turbine.

As shown in FIG. 1, the multistage pressure condenser 1 includes a high pressure side condenser 2 which is connected to an outlet side of the exhaust steam of the steam turbine, and a low pressure side condenser 3 which is connected to an outlet side of the exhaust steam of the steam turbine.

The high pressure side condenser 2 includes a high pressure side body 4 and a high pressure side cooling pipe group 5 which is provided in the high pressure side body 4. The low pressure side condenser 3 includes a low pressure side body 6 and a low pressure side cooling pipe group 7 which is provided in the low pressure side body 6.

A high pressure chamber 8 is formed by the high pressure side body 4 of the high pressure side condenser 2, and a low pressure chamber 9 is formed by the low pressure side body 6 of the low pressure side condenser 3.

In addition, the steam which is introduced to the high pressure chamber 8 from the steam turbine becomes high pressure side steam of a first steam pressure, and the steam which is introduced to the low pressure chamber 9 from the steam turbine becomes low pressure side steam of a second steam pressure. Moreover, the second steam pressure is lower than the first steam pressure.

The low pressure side condenser 3 is partitioned by a pressure partition wall 11 which divides the low pressure side condenser 3 in the vertical direction. The low pressure side cooling pipe group 7 is provided on the upper portion of the low pressure side condenser 3 which is partitioned by the pressure partition wall 11. Moreover, a reheat chamber 12 is provided on the lower portion of the low pressure side condenser 3 which is partitioned by the pressure partition wall 11.

The pressure partition wall 11 has a two-stage configuration, and a low-stage region, which is provided in the vicinity of the center in a plan view, is lowered to the reheat chamber 12 side. The low-stage region of the pressure partition wall 11 is configured to include a porous plate 13 in which a plurality of holes 14 are provided.

The high pressure chamber 8 and the reheat chamber 12 are connected to each other by a steam duct 16, and the high pressure side steam in the high pressure chamber 8 is fed to the reheat chamber 12 from the steam duct 16. In the description below, a flow direction in a flow channel of the high pressure side steam which is introduced to the reheat chamber 12 through the steam duct 16 is referred to as a flow channel direction.

Moreover, the high pressure chamber 8 and the reheat chamber 12 are connected to each other by a connecting pipe 17 in the lower portion. The condensate is fed to the high pressure chamber 8 through the connecting pipe 17 and is mixed with a high pressure side condensate in the high pressure chamber 8.

Cooling water is introduced to the low pressure side cooling pipe group 7 which is provided on the upper portion side of the low pressure side condenser 3. The cooling water which is introduced to the low pressure side cooling pipe group 7 condenses the low pressure side steam which is introduced to the low pressure side condenser 3 to condensate (hereinafter, referred to as low pressure side condensate).

The plurality of holes 14 which configure the porous plate 13 are flow-down holes, and cause the low pressure side condensate which is condensed in the upper portion side of the low pressure side condenser 3 to flow down into the reheat chamber 12.

Figure 2:
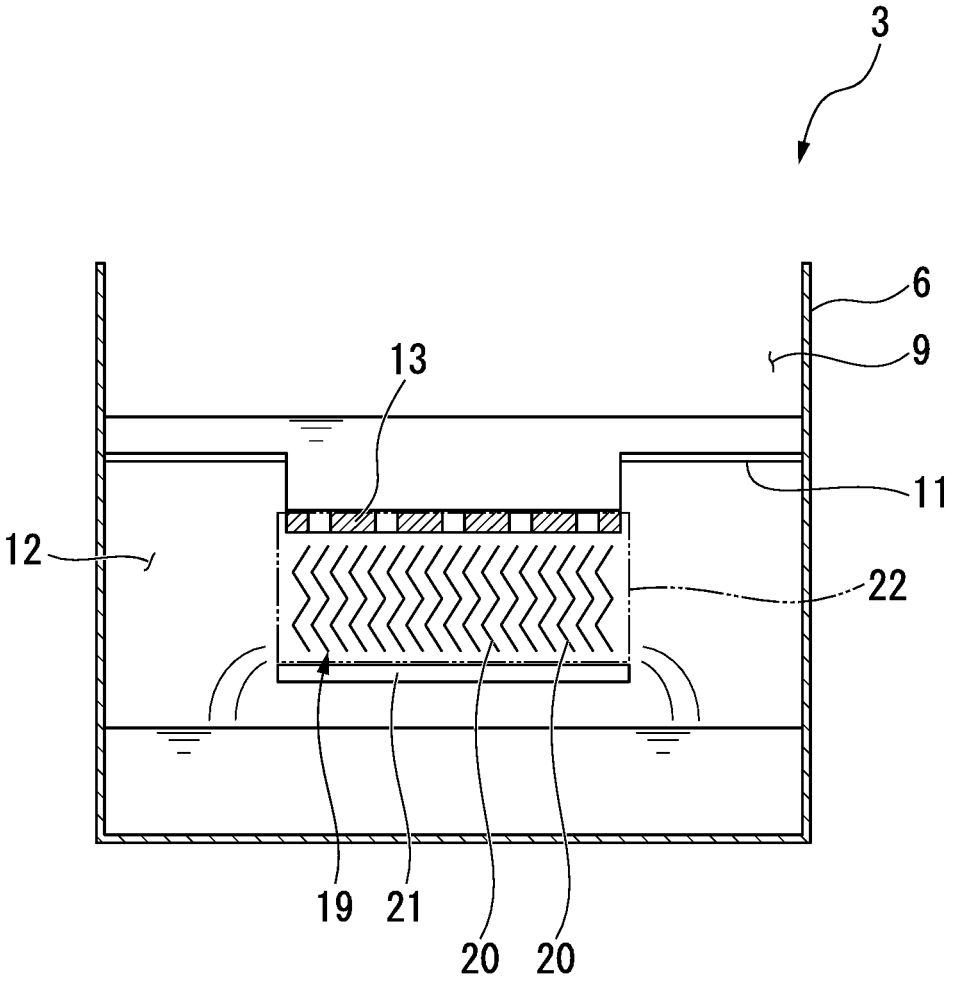
FIG. 2 is a cross-sectional view taken along A-A of FIG. 1.

As shown in FIG. 2, a corrugated plate unit 19, which is configured to include a plurality of corrugated plate members 20, is disposed under (in the reheat chamber 12 side of) the porous plate 13. The corrugated plate unit 19 is constituted by the plurality of (for example, 100 sheets) corrugated plate members 20 having an approximately rectangular plate shape disposed so as to be parallel to each other with the interval of 5 mm, for example, and thus, the overall corrugated plate unit 19 has an approximately rectangular parallelepiped shape. The surfaces of the corrugated plate member 20 are directed so as to be along the flow channel direction. That is, the surfaces are directed so as to be along the extension direction of the steam duct 16.

Figure 3:
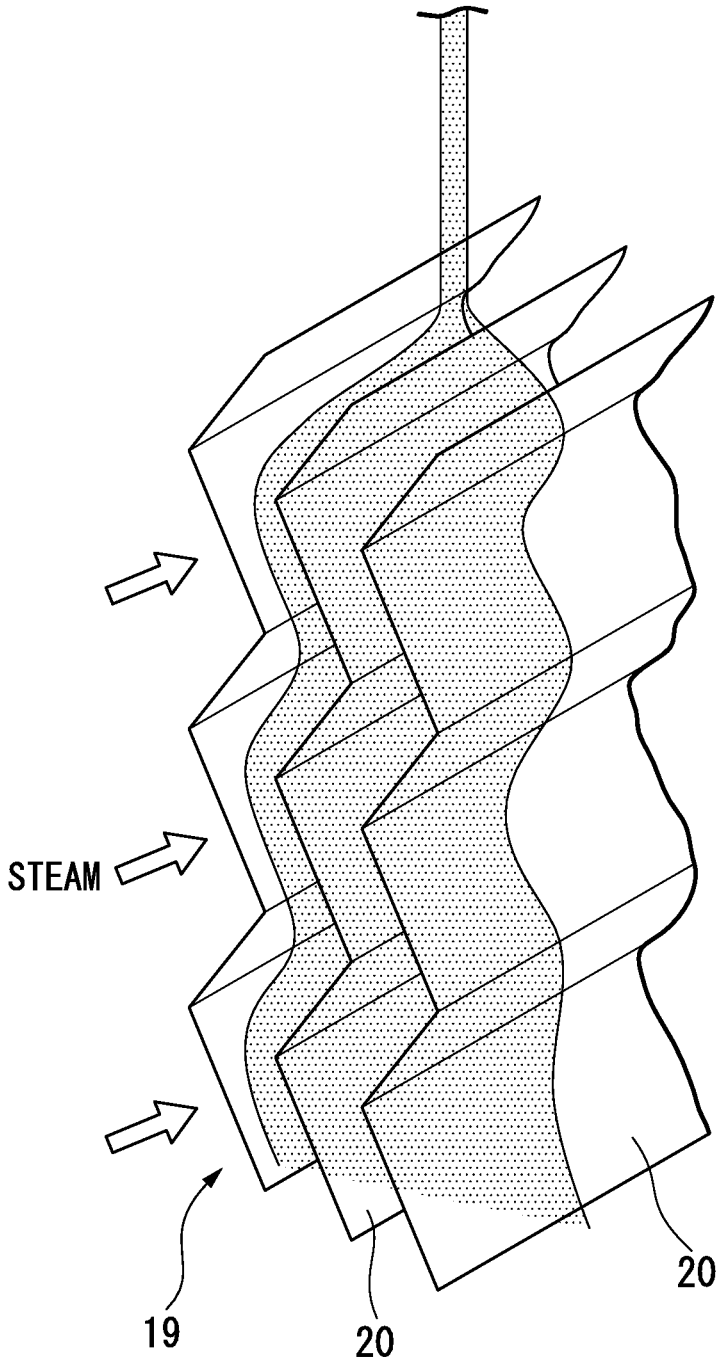
FIG. 3 is a schematic view showing a relationship between low pressure side condensate which flows down between corrugated plate members and high pressure side steam.

As shown in FIGS. 2 and 3, when viewed from the flow channel direction, the shape of the corrugated plate member 20 is formed in an uneven shape (zigzag shape) in which a plurality of (at least one) peaks and troughs are alternately formed toward the flow-down direction of the low pressure side condensate. That is, when viewed from the flow channel direction, the shape of the corrugated plate member is a shape in which the peaks and troughs formed in the left and right are repeated along the vertical direction. For example, the corrugated plate member 20 is manufactured of a SUS 304 so that the thickness is 3 mm.

The plurality of corrugated plate members 20 which configure the corrugated plate unit 19 are disposed so that the peaks and troughs in a vertical direction are aligned with each other. That is, the corrugated plate members 20 are disposed so that the peaks and troughs of the adjacent corrugated plate members 20 are aligned in the horizontal direction.

A tray 21 is provided below the corrugated plate unit 19 and in the lower portion inside the reheat chamber 12. For example, the lower surface of the tray 21 is provided so as to be at a distance of approximately 200 mm from the bottom surface of the low pressure side body 6. The low pressure side condensate flows down to the tray 21 from the corrugated plate. The low pressure side condensate which flows down to the tray 21 is collected (stored) in the tray 21, is overflowed from the tray 21, and falls.

A current plate 22 is mounted to the end portion of the upstream side in the flow channel direction of the corrugated plate unit 19. The current plate 22 is formed in an approximately rectangular plate shape and is a member which has the same shape as the outline of the corrugated plate unit 19 which is formed in an approximately rectangular shape when viewed from the flow channel direction. For example, a plurality of holes are equally disposed on the current plate 22 in a lattice shape, and the current plate is disposed so that the high pressure side steam is introduced into the corrugated plate unit 19 through the plurality of holes.

A buffer case 23 of which the inner portion is a buffer zone 24 is disposed on the end portion of the downstream side in the flow channel direction of the corrugated plate unit 19.

The buffer case 23 is formed in a parallelepiped box shape in which the shape has approximately the same shape as the outline of the corrugated plate unit 19 when viewed from the flow channel direction. The side (upstream side in the flow channel direction) of the box shaped buffer case 23, which faces the corrugated plate unit 19, is opened, and thereby, the high pressure side stream passing through the corrugated plate unit 19 flows into the inner portion of the buffer case 23.

A vent pipe 25 is provided above the buffer case 23. The vent pipe 25 is a tubular member which is provided so as to connect the buffer zone 24 which is an outlet space of the corrugated plate unit 19 and the upper portion of the pressure partition wall 11. In other words, the vent pipe 25 is provided so as to penetrate the pressure partition wall 11, the upper end opening of the vent pipe 25 is opened at the upper portion of the pressure partition wall 11, and the lower end opening of the vent pipe 25 is connected to the buffer case 23.

Next, an operation in which the steam is condensed using the multistage pressure condenser 1 configured as above and becomes the condensate will be described.

For example, seawater as cooling water is supplied to the low pressure side cooling pipe group 7 which is provided in the low pressure side condenser 3. The seawater which is supplied to the low pressure side cooling pipe group 7 is fed out to the high pressure side cooling pipe group 5 of the high pressure side condenser 2 from a connecting pipe (not shown). The seawater which is fed out to the high pressure side cooling pipe group 5 is discharged from a discharging pipe (not shown).

The low pressure side steam which is exhausted after performing the work in the steam turbine is introduced to the upper portion of the low pressure side condenser 3. The low pressure side steam which is introduced to the upper portion of the low pressure side condenser 3 is cooled by the low pressure side cooling pipe group 7 in which the seawater is introduced into each pipe, and thus, is condensed, and becomes the low pressure side condensate of approximately 33° C., for example. The low pressure side condensate which is condensed in this way is stored in the upper portion (the upper portion of the pressure partition wall 11 in FIG. 1) of the low pressure side condenser 3, and forms a condensate collection 10. The distance between the water surface of the condensate collection 10 and the lowermost step of the low pressure side cooling pipe group 7 is approximately 30 cm which is a predetermined distance.

Since the plurality of holes 14 are provided on the porous plate 13 of the pressure partition wall 11, the low pressure side condensate which is stored in the condensate collection 10 flows down from the holes 14. The low pressure side condensate, which flows down through (passes through) the holes 14, flows down along the surfaces of the plurality of corrugated plate members 20 which configure the corrugated plate unit 19 which is provided below the porous plate 13.

On the other hand, the high pressure side steam which is exhausted after performing the work in the steam turbine is introduced into the high pressure side condenser 2. The high pressure side steam which is introduced into the high pressure side condenser 2 is cooled by the high pressure side cooling pipe group 5 in which the seawater is introduced into each pipe, and thus, is condensed, becomes condensate (hereinafter, referred to as "high pressure side condensate"), and is stored in the high pressure side condenser 2.

Since the high pressure side condenser 2 and the reheat chamber 12 of the low pressure side condenser 3 is connected to each other by the steam duct 16, the high pressure side steam in the high pressure side condenser 2 is introduced to the reheat chamber 12 from the steam duct 16.

The high pressure side steam, which is introduced to the reheat chamber 12, is introduced into the corrugated plate unit 19 through the holes of the current plate 22, and comes into gas-liquid contact with the low pressure side condensate which flows down along the surfaces of the corrugated plate members 20 from the porous plate 13. At this time, the high pressure side steam is straightened, and a flow rate in the surfaces perpendicular to the flow channel direction is uniformized.

At this time, the flow of the high pressure side steam is promoted by the vent pipe 25. That is, since the vent pipe 25 connects the buffer zone 24 into which the high pressure side steam passing through the corrugated plate unit 19 flows and the upper portion of the pressure partition wall 11 in which the pressure is lower than the pressure of the buffer zone 24, the vent pipe exhibits an operation which forcibly extracts the high pressure side steam. That is, since the vent pipe generates forced convention which extracts the high pressure side steam in the corrugated plate unit 19, the flow rate of the high pressure side steam in the corrugated plate unit 19 is increased.

The low pressure side condensate which flows down along the surfaces of the corrugated plate members 20 is collected on the tray 21 from the lower end of the corrugated plate unit 19. The low pressure side condensate which is collected in the tray 21 is overflowed from the tray 21 and falls. That is, the low pressure side condensate which falls from the tray 21 is stored in the reheat chamber 12.

A merging part (not shown) is provided in the lower portion of the reheat chamber 12. The connecting pipe 17 which is bypass means connects between the merging part and the lower portion of the high pressure side condenser 2. The high pressure side condensate which is stored in the high pressure side condenser 2 is introduced to the merging part via the connecting pipe 17, merges with the low pressure side condensate, and becomes condensate. The condensate merged in the merging part is fed out to the feed water heater using a condensate pump (not shown).

Since the high pressure side condensate which is introduced to the merging part from the connecting pipe 17 bypasses the low pressure side condensate which is stored in the reheat chamber 12 and is introduced to the merging part, the high pressure side condensate can be merged with the low pressure side condensate in a state where the high pressure side condensate is maintained at a high temperature. Therefore, the condensate having a high temperature can be fed out from the condensate pump.

In the above-described embodiment, since the corrugated plate members 20 which configure the corrugated plate unit 19 include the plurality of uneven shapes, as shown in FIG. 3, the low pressure side condensate which flows down from the porous plate 13 alternately flows on inclined surfaces of the two adjacent corrugated plate members 20 and forms a film. In addition, the duration, in which the low pressure side condensate moves (flows down to) on the surfaces of the corrugated plate members 20, is increased. Thereby, the duration in which the low pressure side condensate which flows down on the surfaces of the corrugated plate members 20 and the high pressure side steam come into gas-liquid contact with each other is increased. Therefore, compared to a case where the corrugated plate members 20 are not used, the temperature of the low pressure side condensate which is heated by the high pressure side steam is increased.

Moreover, since the plurality of corrugated plate members 20 are disposed along the flow-down direction of the low pressure side condensate and the flow channel direction of the high pressure side steam, the high pressure side steam is perpendicular to the flow-down direction of the low pressure side condensate, and the high pressure side steam flows in the interval between the corrugated plate members 20. Thereby, the low pressure side condensate which flows down in a film and the high pressure side steam come into more efficient contact with each other.

In addition, since the vent pipe 25 which is air feeder for generating forced convection in the corrugated plate unit 19 is provided in the further downstream side in the flow channel direction than the corrugated plate unit 19, the flow of the high pressure side steam is promoted in the outlet side (the downstream side in the flow channel direction) of the corrugated plate unit 19, and a decrease in the flow rate is prevented. Thereby, forced convection condensation is promoted, and performance of the corrugated plate unit 19 can be enhanced.

Moreover, since the current plate 22 is disposed in the further upstream side in the flow channel direction than the corrugated plate unit 19, the high pressure side steam is straightened, and the flow rate in the surfaces perpendicular to the flow channel direction is uniformized. Thereby, it is possible to prevent efficiency from being decreased due to ununiformity of the flow rate in the surfaces perpendicular to the flow channel direction.

Moreover, the tray 21 which stores and overflows the low pressure side condensate which flows down from the corrugated plate member 20 is provided below the corrugated plate unit 19. Thereby, the low pressure side condensate which overflows and flows down from the tray 21 generates a circulation flow in the low pressure side condensate which is stored in the reheat chamber 12, and the low pressure side condensate comes into contact with the high pressure side steam, which is introduced to the reheat chamber 12, with a wider area. Therefore, the reheating efficiency can be increased.

As described above, the condensate in which improved heat transfer is performed and the temperature is efficiently increased is obtained. Thereby, the condensate can be sufficiently heated without changing the distance in which the low pressure side condensate falls down, that is, the distance between the pressure partition wall 11 and the bottom surface of the low pressure side body 6. Therefore, the reheating efficiency can be further improved without increasing the size of the multistage pressure condenser 1. Thereby, the efficiency of a steam turbine plant (not shown) can be improved without changing the overall disposition or the size of the plant.

Second Embodiment

The multistage pressure condenser and the steam turbine having the same of the present embodiment are different from the first embodiment in that a valve is provided in the vent pipe, and others are similar to the first embodiment. Therefore, the same reference numerals are attached to the same configurations, and the descriptions are omitted.

Figure 4:
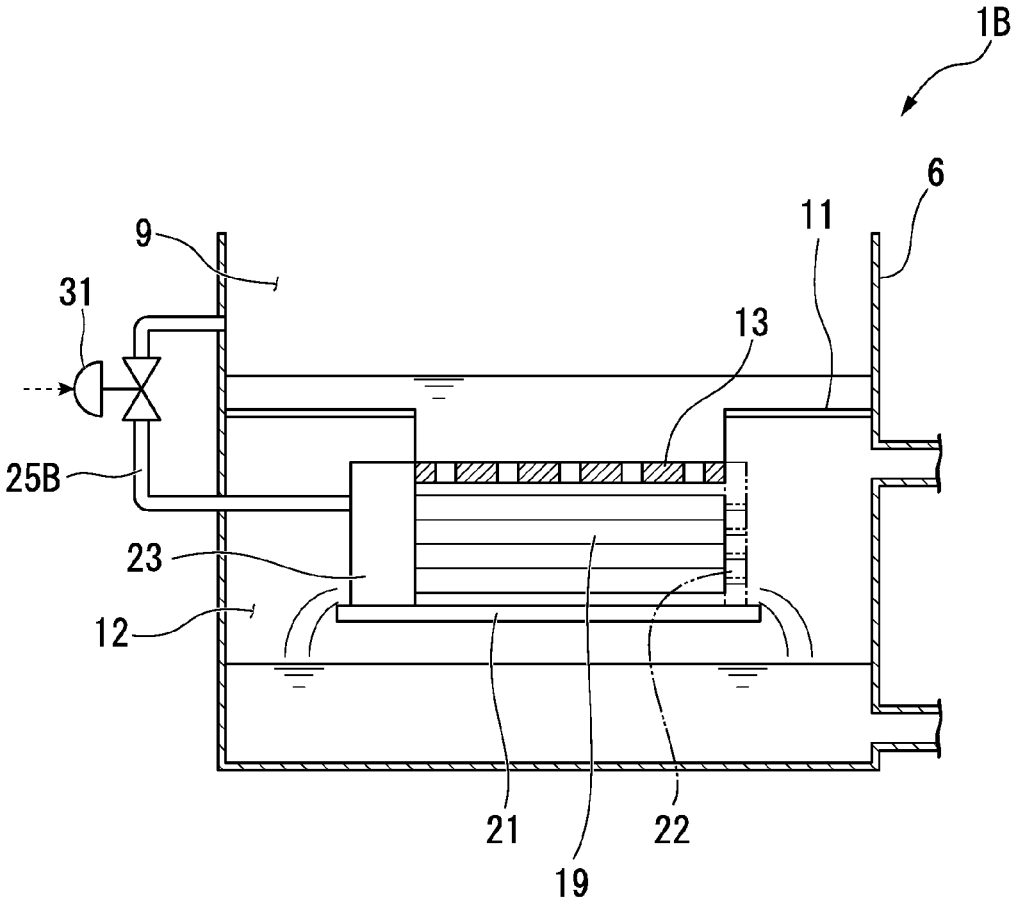
FIG. 4 is a partially schematic configuration view of a low pressure side condenser of a multistage pressure condenser according to a second embodiment of the present invention.

As shown in FIG. 4, after a vent pipe 25B of a multistage pressure condenser 1B of the present embodiment extends up to the outside of the low pressure side body 6 in the horizontal direction from the buffer case 23, the vent pipe extends upward and is connected to the upper portion of the pressure partition wall 11 in the low pressure chamber 9. That is, the second embodiment is the same as the first embodiment in that the buffer zone 24 which is an outlet space of the corrugated plate unit 19 and the upper portion of the pressure partition wall 11 are connected to each other. However, pathways are different from each other.

In addition, a valve 31 is provided outside the low pressure side body 6 in the middle of the vent pipe 25B. For example, the valve 31 is a butterfly valve and can change the flow rate of the high pressure side steam which flows through the vent pipe 25B.

According to the second embodiment, since the valve 31 which adjusts the flow rate of the high pressure side steam flowing through the vent pipe 25B is provided, the degree of the forced convection caused by the vent pipe 25B can be adjusted, and the flow rate of the high pressure side steam can be adjusted. Thereby, promotion of the flow of the high pressure side steam due to the vent pipe 25 can be adjusted in consideration of, for example, the load on the low pressure side cooling pipe group 7 due to the increase of the flow rate of the high pressure side steam.

Moreover, the device which adjusts the flow rate of the high pressure side steam is not limited to the valve 31. For example, an orifice may be used for the adjuster.

Third Embodiment

The multistage pressure condenser and the steam turbine having the same of the present embodiment are different from the first embodiment in that the vent pipe and the buffer case are removed and a fan for forcibly increasing the flow rate of the high pressure side steam is provided in the steam duct, and others are similar to the first embodiment. Therefore, the same reference numerals are attached to the same configurations, and descriptions thereof are omitted here.

Figure 5:
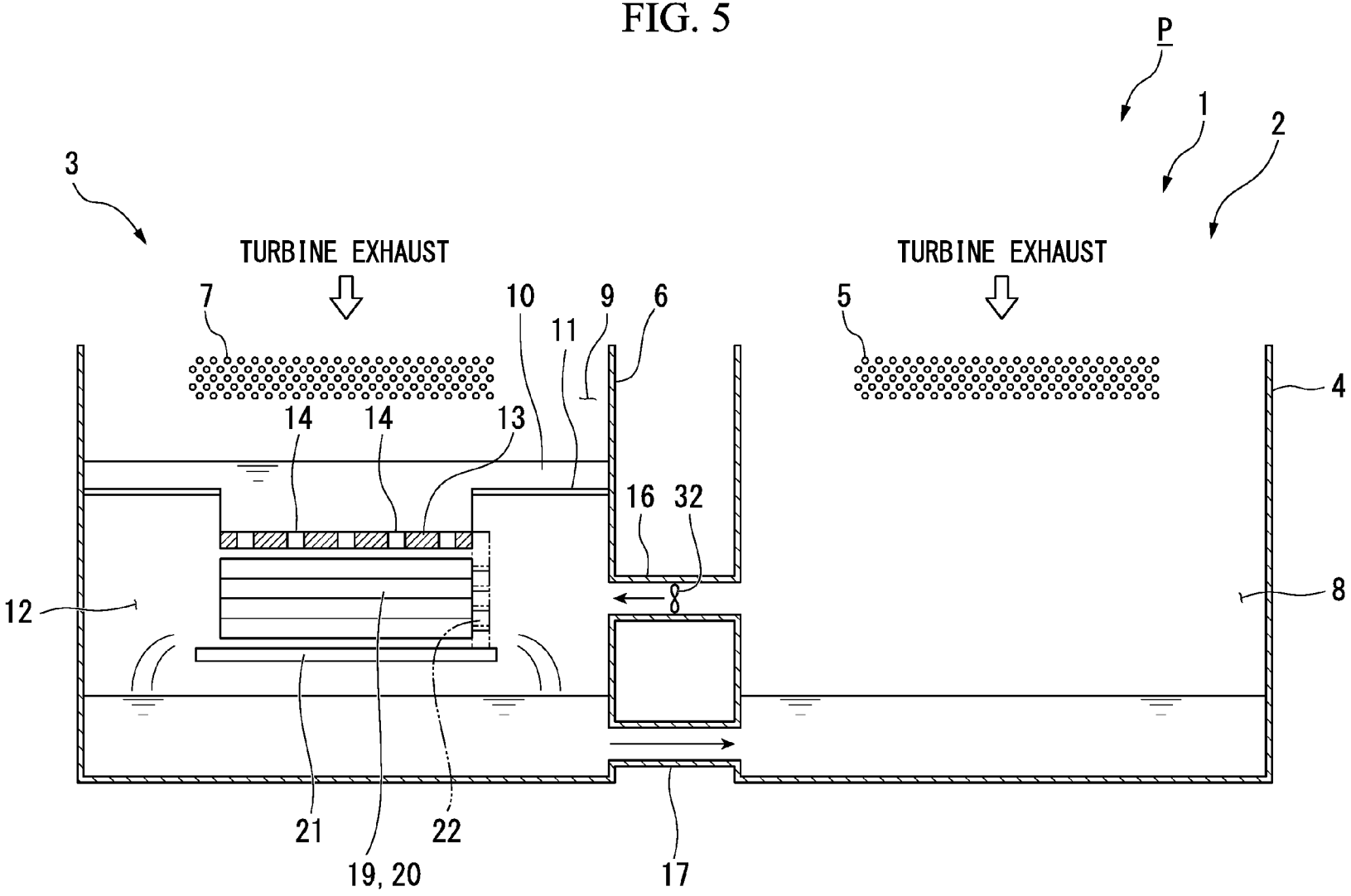
FIG. 5 is a schematic configuration view of a multistage pressure condenser according to a third embodiment of the present invention.

As shown in FIG. 5, the current plate 22 similar to that of the first embodiment is mounted to the end in the upstream side in the flow channel direction of the corrugated plate unit 19 of the present embodiment. Meanwhile, the downstream side in the flow channel direction of the corrugated plate unit 19 is opened. That is, unlike the first embodiment, the vent pipe and the buffer case are not installed.

A fan 32 is disposed in the steam duct 16 of the present embodiment. For example, the fan 32 is a blower which blows air by rotating blades using an electric motor and is installed so as to strengthen (apply kinetic energy to) the flow of the air current which flows into the reheat chamber 12 from the high pressure chamber 8. That is, the flow rate of the high pressure side steam which is introduced to the reheat chamber 12 through the steam duct 16 can be increased.

According to the third embodiment, since the flow rate of the high pressure side steam which flows into the corrugated plate unit 19 through the current plate 22 can be increased due to the fan 32, the forced convection condensation is promoted, and performance of the corrugated plate unit 19 can be increased.

Fourth Embodiment

The multistage pressure condenser and the steam turbine having the same of the present embodiment are different from the first embodiment in that the corrugated plate members include pocket parts which are opened toward the low pressure side condensate which flows down, and others are similar to the first embodiment. Therefore, the same reference numerals are attached to the same configurations, and descriptions thereof are omitted here.

Figure 6:
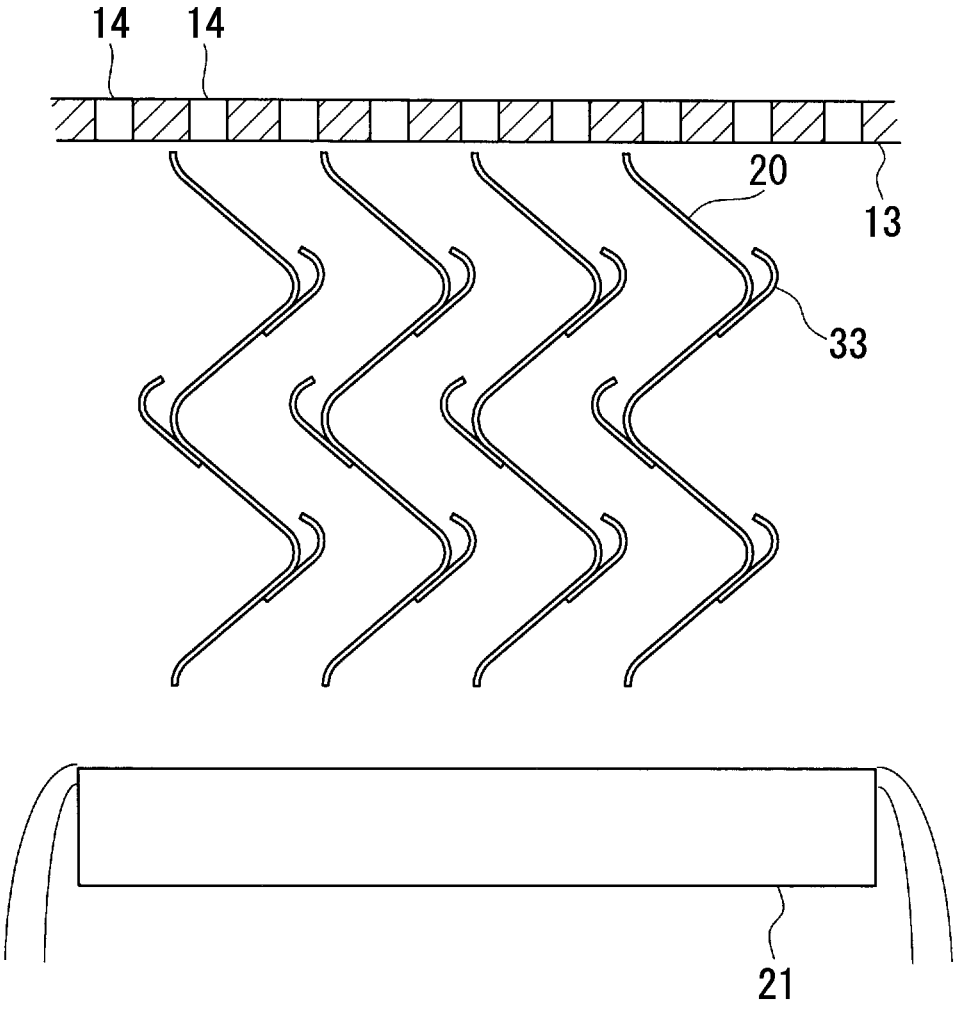
FIG. 6 is a partially schematic configuration view showing a corrugated plate unit of a multistage pressure condenser according to a fourth embodiment of the present invention.

As shown in FIG. 6, in the corrugated plate members 20 of the multistage pressure condenser according to the present embodiment, the shape when viewed from the flow channel direction forms an uneven shape in which the plurality of (at least one) peaks and troughs are alternately formed toward the flow-down direction of the low pressure side condensate, and convex portions of the uneven shape include pocket parts 33 which are opened toward the low pressure side condensate which flows down along the surfaces of the corrugated plate members 20.

The low pressure side condensate which flows down along the surfaces of the corrugated plate members 20 from the holes 14 of the porous plate 13 reaches the convex portions of the uneven shape. Since the pocket parts 33 which are opened toward the flow-down direction of the low pressure side condensate are provided on the convex portions, the low pressure side condensate flows into the pocket parts 33.

The low pressure side condensate which is stored in the pocket parts 33 is overflowed from the pocket parts 33 and flows down along the surfaces of concave portions of the corrugated plate members 20 which are positioned below the pocket parts 33. In this way, the low pressure side condensate which flows down from the holes 14 of the porous plate 13 flows down to the tray 21 by being introduced to the pocket parts 33 from the surfaces of convex portions of the corrugated plate member 20, overflowing from the pocket parts 33, and flowing down along the surfaces of concave portions repeatedly.

According to the fourth embodiment, the low pressure side condensate which is introduced to the pocket parts 33 from the surfaces of the convex portions of the corrugated plate members 20 agitates the low pressure side condensate which is stored in the pocket parts 33. Thereby, a contact area between the low pressure side condensate and the high pressure side steam is increased. Therefore, excellent heat transfer can be performed, and thus, the temperature of the low pressure side condensate which flows down on the corrugated plate members 20 can be efficiently increased.

Moreover, the technical scope of the present invention is not limited to the above-described embodiments, and various modifications can be added within the scope which does not depart from the gist of the present invention.

In each embodiment described above, it is described that the two-stage condenser which includes the high pressure side condenser 2 and the low pressure side condenser 3 is used as the multistage pressure condenser 1. However, for example, a condenser which includes three stages of a high pressure side condenser, an intermediate pressure side condenser, and a low pressure side condenser may be used. In this case, the corrugate plate units are installed below the pressure partition walls which are respectively provided on the intermediate pressure side condenser in which the pressure is lower than that of the high pressure side condenser, and on the low pressure side condenser in which the pressure is lower than that of the intermediate pressure side condenser.

Moreover, in each embodiment described above, the plurality of corrugated plate members are used as the device for forming the low pressure side condensate in a film. However, the present invention is not limited thereto. The low pressure side condensate may be formed in a film using a flat plate shaped tray, and the high pressure side steam in which the flow is promoted due to the vent pipe may be applied to the low pressure side condensate which is formed in a film. That is, a configuration may be used in which the current plate and the vent pipe are provided in the conventional multistage pressure condenser which does not include the corrugated plate unit.

Figure 7:
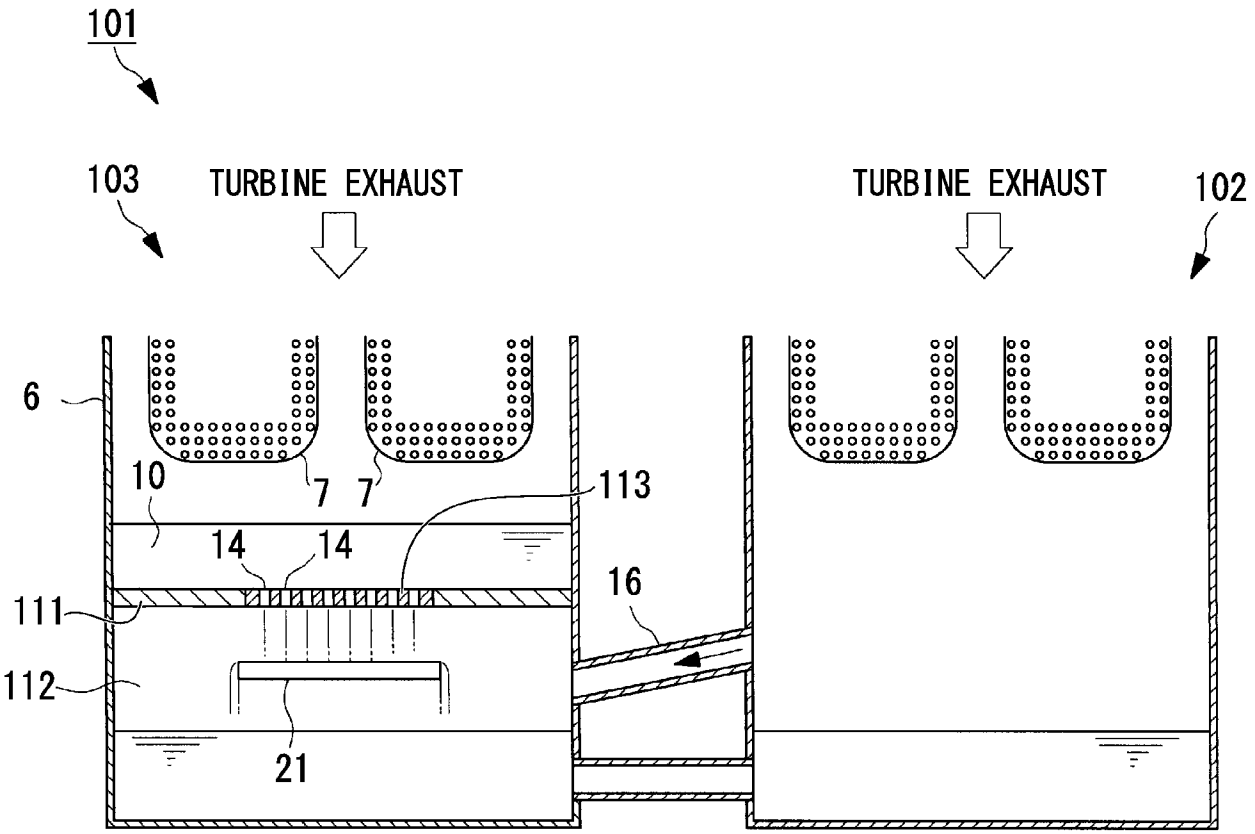
FIG. 7 PRIOR ART
FIG. 7 is a schematic configuration view of a conventional multistage pressure condenser.
Figure 8:
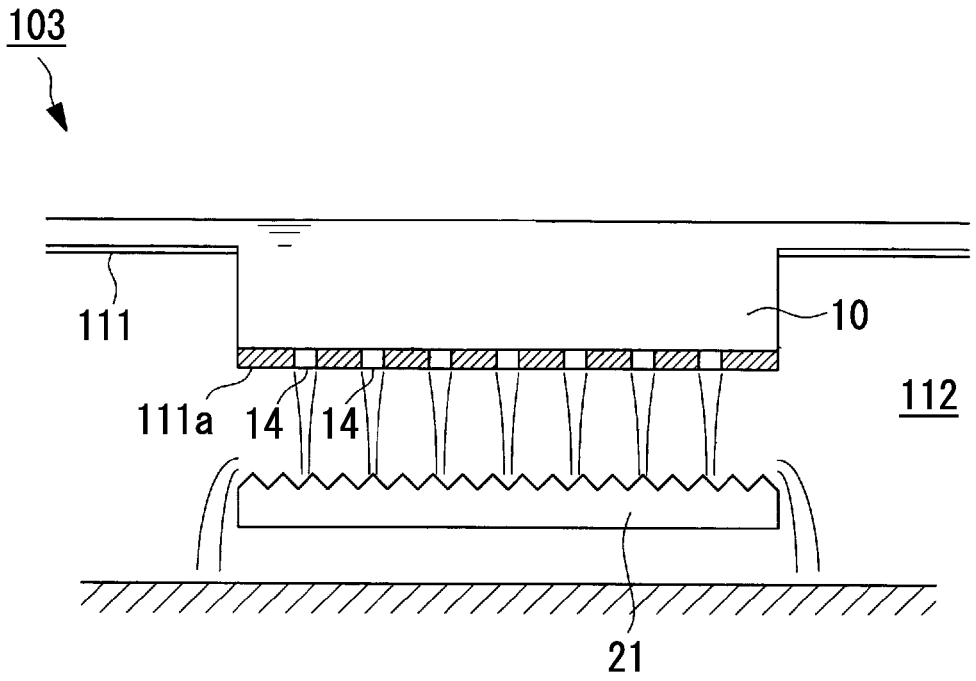
FIG. 8 PRIOR ART
FIG. 8 is a schematic configuration view of a modification of a low pressure side condenser of the multistage pressure condenser shown in FIG. 7.

Moreover, in each embodiment described above, a flat plate configuration as shown in FIG. 7 may be used without a two-stage configuration in which the pressure partition wall is lowered to the reheat chamber side by one stage.

INDUSTRIAL APPLICABILITY

The present invention relates to a multistage pressure condenser which includes: a plurality of pressure chambers in which pressures are different from one another; a high pressure chamber, which is maintained to a first steam pressure, of the pressure chambers; a low pressure chamber, which is maintained to a second steam pressure which is lower than the first steam pressure, of the pressure chambers; a pressure partition wall which partitions an inner portion of the low pressure chamber to an upper portion and a lower portion and includes a porous plate which includes a plurality of holes; a cooling pipe group which is provided on the upper portion of the low pressure chamber partitioned by the pressure partition wall and condenses low pressure side steam to low pressure side condensate by exchanging heat with the low pressure side steam, which is introduced to the low pressure chamber, through introduced cooling water; a reheat chamber which is positioned in the lower portion of the low pressure chamber partitioned by the pressure partition wall and in which the lower pressure side condensate which flows down through the porous plate is stored; high pressure side steam introduction portion for introducing high pressure side steam, which is introduced to a high pressure chamber in the high pressure chamber to the reheat chamber; liquid-film forming portion which is provided in a flow channel of the high pressure side steam introduced to the reheat chamber and guides the low pressure side condensate which flows down through the porous plate to the reheat chamber while dispersing the low pressure side condensate on a surface; and air feeder for promoting the flow of the high pressure side steam which is introduced by the high pressure side steam introduction portion. According to the present invention, the low pressure side condenser in which a liquid-film is formed due to the liquid-film forming portion and the high pressure side steam in which the flow is promoted due to the air feeder come into gas-liquid contact with each other, and thus, forced convection condensation is promoted, and the low pressure side condensate can be further heated.

DESCRIPTION OF SYMBOLS

P: steam turbine plant
1: multistage pressure condenser
2: high pressure side condenser
3: low pressure side condenser
7: low pressure side cooling pipe group (cooling pipe group)
8: high pressure chamber
9: low pressure chamber
11: pressure partition wall
12: reheat chamber
13: porous plate
14: hole
16: steam duct (high pressure side steam introduction portion)
19: corrugated plate unit (liquid-film forming portion)
20: corrugated plate member (plate-shaped member)
25: vent pipe (air feeder)
31: valve (adjuster)
32: fan (blower)

The invention claimed is:

1. multistage pressure condenser comprising:

a plurality of pressure chambers in which pressures are different from one another, the plurality of pressure chambers including:

a high pressure chamber, into which high pressure side steam is introduced and which maintains the high pressure side steam at a first steam pressure; and a low pressure chamber, into which low pressure side steam is introduced and which maintains the low pressure side steam at a second steam pressure which is lower than the first steam pressure;

a pressure partition wall configured to partition an inner portion of the low pressure chamber into an upper portion and a lower portion and which includes a porous plate in which a plurality of holes are formed;

a cooling pipe group provided at the upper portion of the low pressure chamber partitioned by the pressure partition wall, the cooling pipe group exchanging heat with the low pressure side steam through cooling water introduced to the cooling pipe group, thereby condensing the low pressure side steam to low pressure side condensate;

a reheat chamber positioned in the lower portion of the low pressure chamber partitioned by the pressure partition wall, the reheat chamber storing the low pressure side condensate which flows down through the porous plate;

a steam duct configured to connect the high pressure chamber and the reheat chamber and introduce the high pressure side steam to the reheat chamber;

a corrugated plate unit positioned under the porous plate, the corrugated plate unit configured to guide the low pressure side condensate which flows down through the porous plate to the reheat chamber while dispersing the low pressure side condensate on a surface of the corrugated plate unit;

a vent pipe configured to introduce the high pressure side steam into the corrugated plate unit while promoting the flow of the high pressure side steam which is introduced through the steam duct; and a current plate provided to the corrugated plate unit, wherein the vent pipe penetrates the pressure partition wall, is located further downstream than the corrugated plate unit in a flow channel direction of the high pressure side steam, and circulates the high pressure side steam to the upper portion of the low pressure chamber from the reheat chamber, and wherein the current plate is located further upstream than the corrugated plate unit in the flow channel direction of the high pressure side steam, straightens the high pressure side steam, and introduces the high pressure side steam into the corrugated plate unit.

2. The multistage pressure condenser according to claim 1, further comprising a valve located in the vent pipe, the valve being configured to adjust a flow rate of the high pressure side steam which flows in the vent pipe.

3. multistage pressure condenser comprising:

a plurality of pressure chambers in which pressures are different from one another, the plurality of pressure chambers including:

a high pressure chamber, into which high pressure side steam is introduced and which maintains the high pressure side steam at a first steam pressure; and a low pressure chamber, into which low pressure side steam is introduced and which maintains the low pressure side steam at a second steam pressure which is lower than the first steam pressure;

a pressure partition wall configured to partition an inner portion of the low pressure chamber into an upper portion and a lower portion and which includes a porous plate in which a plurality of holes are formed;

a cooling pipe group provided at the upper portion of the low pressure chamber partitioned by the pressure partition wall, the cooling pipe group exchanging heat with the low pressure side steam through cooling water introduced to the cooling pipe group, thereby condensing the low pressure side steam to low pressure side condensate;

a reheat chamber positioned in the lower portion of the low pressure chamber partitioned by the pressure partition wall, the reheat chamber storing the low pressure side condensate which flows down through the porous plate;

a steam duct configured to connect the high pressure chamber and the reheat chamber and introduce the high pressure side steam to the reheat chamber;

a corrugated plate unit positioned under the porous plate, the corrugated plate unit configured to guide the low pressure side condensate which flows down through the porous plate to the reheat chamber while dispersing the low pressure side condensate on a surface of the corrugated plate unit;

a blower disposed in the steam duct and configured to introduce the high pressure side steam into the corrugated plate unit while promoting the flow of the high pressure side steam which is introduced through the steam duct; and a current plate provided to the corrugated plate unit, wherein the current plate is located further upstream than the corrugated plate unit in a flow channel direction of the high pressure side steam, straightens the high pressure side steam, and introduces the high pressure side steam into the corrugated plate unit, and wherein the blower introduces the high pressure side steam into the corrugated plate unit through the current plate.

4. The multistage pressure condenser according to claim 1, wherein the corrugated plate unit includes a plurality of plate-shaped members which are disposed along a flow-down direction of the low pressure side condensate and the flow channel direction of the high pressure side steam, and are disposed to be parallel to each other with intervals in an orthogonal direction perpendicular to the flow-down direction and the flow channel direction, and each of the plate-shaped members has a shape in which a cross-sectional shape is uneven in the orthogonal direction when viewed from the flow channel direction, and is configured such that the low pressure side condensate flows down its surface.

5. The multistage pressure condenser according to claim 2, wherein the corrugated plate unit includes a plurality of plate-shaped members which are disposed along a flow-down direction of the low pressure side condensate and the flow channel direction of the high pressure side steam, and are disposed to be parallel to each other with intervals in an orthogonal direction perpendicular to the flow-down direction and the flow channel direction, and each of the plate-shaped members has a shape in which a cross-sectional shape is uneven in the orthogonal direction when viewed from the flow channel direction, and is configured such that the low pressure side condensate flows down its surface.

6. The multistage pressure condenser according to claim 3, wherein the corrugated plate unit includes a plurality of plate-shaped members which are disposed along a flow-down direction of the low pressure side condensate and the flow channel direction of the high pressure side steam, and are disposed to be parallel to each other with intervals in an orthogonal direction perpendicular to the flow-down direction and the flow channel direction, and each of the plate-shaped members has a shape in which a cross-sectional shape is uneven in the orthogonal direction when viewed from the flow channel direction, and is configured such that the low pressure side condensate flows down its surface.

7. steam turbine plant comprising:

the multistage pressure condenser according to claim 1.

8. The steam turbine plant according to claim 7, further comprising a valve located in the vent pipe, the valve being configured to adjust a flow rate of the high pressure side steam which flows in the vent pipe.

9. steam turbine plant comprising:

the multistage pressure condenser according to claim 3.

10. The steam turbine plant according to claim 7, wherein the corrugated plate unit includes a plurality of plate-shaped members which are disposed along a flow-down direction of the low pressure side condensate and the flow channel direction of the high pressure side steam, and are disposed to be parallel to each other with intervals in an orthogonal direction perpendicular to the flow-down direction and the flow channel direction, and each of the plate-shaped members has a shape in which a cross-sectional shape is uneven in the orthogonal direction when viewed from the flow channel direction, and is configured such that the low pressure side condensate flows down its surface.

11. The steam turbine plant according to claim 9, wherein the corrugated plate unit includes a plurality of plate-shaped members which are disposed along a flow-down direction of the low pressure side condensate and the flow channel direction of the high pressure side steam, and are disposed to be parallel to each other with intervals in an orthogonal direction perpendicular to the flow-down direction and the flow channel direction, and each of the plate-shaped members has a shape in which a cross-sectional shape is uneven in the orthogonal direction when viewed from the flow channel direction, and is configured such that the low pressure side condensate flows down its surface.

* * * * *